United States Patent [19]

Jordan et al.

[11] Patent Number: 4,606,464

[45] Date of Patent: Aug. 19, 1986

[54] DISHWASHER RACK WITH PIVOTED DIVIDER ASSEMBLY

[75] Inventors: Lawrence J. Jordan; Paul F. Schell, both of Newton, Iowa

[73] Assignee: The Maytag Company, Newton, Iowa

[21] Appl. No.: 692,216

[22] Filed: Jan. 17, 1985

[51] Int. Cl.[4] ..... A47G 19/08

[52] U.S. Cl. ..... 211/41; 211/184

[58] Field of Search ..... 211/41, 184, 80, 85, 211/74; 108/61; 312/311, 132

[56] References Cited

U.S. PATENT DOCUMENTS

| | | | |
|---|---|---|---|
| 990,454 | 4/1911 | Peters | 211/41 |
| 1,412,592 | 4/1922 | Allsop et al. | 211/41 X |
| 1,822,087 | 9/1931 | Feingold | 211/41 X |
| 1,971,523 | 8/1934 | Feingold | 211/41 |
| 2,516,088 | 7/1950 | Einhorn | 211/41 |
| 2,841,288 | 7/1958 | Field et al. | 211/41 |
| 3,126,098 | 3/1964 | Geiger et al. | 211/41 |
| 3,388,808 | 6/1968 | Radek | 211/184 X |
| 3,451,556 | 6/1969 | Macoicz | 211/41 |
| 3,464,566 | 9/1969 | Gilson | 211/41 |
| 3,486,804 | 12/1969 | Kaufman et al. | 312/311 |

*Primary Examiner*—Ramon S. Britts
*Assistant Examiner*—Sarah A. Lechok Eley
*Attorney, Agent, or Firm*—Richard L. Ward

[57] ABSTRACT

A dishwasher rack having substantially upstanding front, rear and side walls and a generally horizontally disposed bottom wall formed from a plurality of longitudinal and lateral wire members includes at least one pivoted divider. The pivoted dividers are each located between a pair of pivot support members which are secured to adjacent wires of the rack bottom by oppositely facing grooves and a deformable locking member. Each pivot support member includes a spring biasing arm having a cam member engageable with a follower associated with a pivoted divider. The cam member and biasing arm cooperate with the follower of the pivoted divider for controlling the positioning of the pivoted divider in either an upright or folded posture.

15 Claims, 7 Drawing Figures

DISHWASHER RACK WITH PIVOTED DIVIDER ASSEMBLY

BACKGROUND OF THE INVENTION

This invention relates to racking systems for dishwashing appliances and in particular to dishwasher racks having pivoted divider assemblies which enhance the loading flexibility of these racks.

In the design of dishwasher racks it has generally been industry practice to design racks with dish support members arranged for loading "standard" dish sizes. It is, however, likely that most households will include some "non-standard" dishes as well as various odd shaped cooking utensils which will not load properly in a dishwasher rack designed for only "standard" dishes. To alleviate the problem presented by "non-standard" dishes and other cooking utensils, several rack designs have evolved which have included movable or adjustable portions.

Geiger et al, in U.S. Pat. No. 3,269,548 issued Aug. 30, 1966, teach a rack system which is vertically adjustable within the dishwasher to accommodate large articles. The upper rack also includes several pivoted divider members. Each of the pivoted divider members is formed of wire members and is supported on the upper rack by a pair of hinge clips secured to the base of the wire rack for supporting the ends of the pivoted divider members. A separate sheet metal detent member is positioned at the end of the rack for holding the pivoted divider members in the upright position.

Smith, in U.S. Pat. No. 3,402,975 issued Sept. 24, 1968, teaches a top loading dishwasher having two levels of dishracks. Access to the lower dishrack is attained by utilizing a horizontally movable rack in cooperation with a hinged shelf which is pivotally supported between a pair of the dishwasher side walls at one end and by a portion of the movable rack at the other end. The hinged shelf includes a pair of pivotal divider assemblies each of which may be maintained in an upright posture by a detent assembly at one end of the divider assembly.

Fiocca et al, in U.S. Pat. No. 3,752,322 issued Aug. 14, 1973, teach a dishwasher rack construction in which a pivoted element can be retained in one of a plurality of intermediate positions by an arcuate toothed member located at the front of the rack.

Yake, in U.S. Pat. No. 4,046,261 issued Sept. 6, 1977, discloses a dishwasher rack which includes a pair of brackets fixed to the bottom of the rack and having molded slots and retainers for receiving a plurality of fences in a plurality of positions. These fences are either vertically mounted between the pair of brackets or are removed from the dishwasher rack. There is no pivotal movement of individual fences but only selective use of these fences for adjusting the distance between adjacent fences and between the rack side walls.

Prior patents show that considerable effort has been focused on the development of dishwasher racks and on the development of dishwasher racks which include flexible or variable spacing arrangements for accommodating a variety of dish loads. In spite of these previous efforts there has been no known showing of the present dishwasher rack with a pivoted divider which includes a unique divider support member, means for mounting the support member to the dishwasher rack and biasing means associated with the support member for controlling the location of the divider as it is manually pivoted between folded and upright postures.

SUMMARY OF THE INVENTION

It is therefore an object of the instant invention to provide an improved dishwasher rack with pivoted divider.

It is a further object of the instant invention to provide a dishwasher rack with pivoted dividers which are easily adjustable for allowing variations in the size and shape of dishes and utensils to be washed.

It is a still further object of the instant invention to provide a dishwasher rack with a pivoted divider in which the rack divider support member is positively secured to the dishwasher rack.

It is yet another object of the instant invention to provide biasing means for positively positioning the individual pivoted elements of the dishwasher rack into the upright posture and for urging the individual pivoted elements of the dishwasher rack into the folded posture.

Briefly, the instant invention achieves these objects in a dishwasher rack assembly having a pivoted divider member. The dishwasher rack has a bottom wall including a plurality of spaced-apart longitudinal and lateral wire members. A pivoted divider has a selectable upright position and includes a plurality of generally upstanding wire elements connected to at least one generally horizontal wire element. At least one unitary support member is provided for pivotally supporting the pivoted divider on the bottom wall for movement between the upright position and a folded-down position. The support member includes a body portion and attaching apparatus engageable with wire members of the dishwasher rack for attaching the support member to the bottom wall. At least one pivot aperture is associated with the body portion for receiving an end portion of the pivoted divider. A combination camming and biasing member is integral with the body portion of the support member and is engageable with a portion of the pivoted divider for biasing thereof toward one of the upright and folded-down positions.

Details of the dishwasher rack with pivoted divider assembly and further objects and advantages thereof will become evident as the description proceeds and from an examination of the accompanying three sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
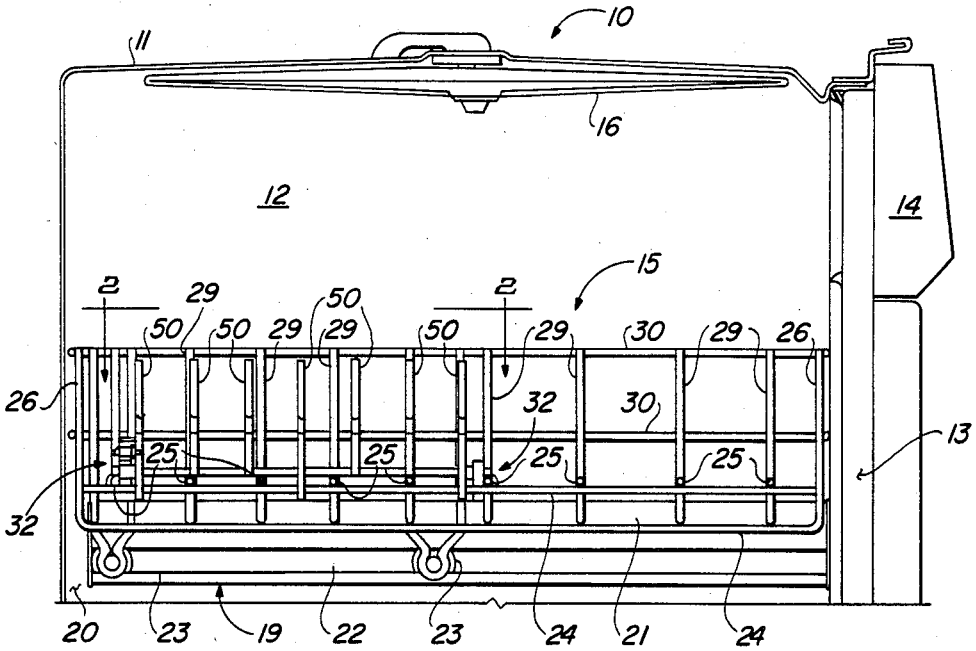
FIG. 1 is a partial section view of the upper portion of a dishwashing apparatus showing a dishwasher rack incorporating the instant invention.

There is shown generally in FIG. 1 the upper interior portion of a dishwashing apparatus 10. The dishwashing apparatus 10 includes a tub 11 forming a washing chamber 12 and a door 13 for providing access to the washing chamber 12. The door 13 further includes a control panel 14 for housing a timer and various other control elements (not shown) operable for controlling the dishwashing apparatus 10 through a prescribed cycle of operations including the washing, rinsing and drying of dishes and silverware.

Located within the washing chamber 12 are racks and/or baskets 15 for loading dishes and silverware which are to be washed. The top wash arm 16 shown in FIG. 1 directs a portion of the washing liquid downwardly into the racks and baskets 15 and a bottom wash arm (not shown) directs a portion of the washing liquid upwardly into the racks and baskets 15. The combined washing liquid thus completely engulfs the racks and baskets 15 and provides vigorous washing action to the articles contained therein. The dishwashing apparatus 10 as partially shown in FIG. 1 is further disclosed in U.S. Pat. No. 3,906,967 issued Sept. 23, 1975 to Richard P. Bergeson and assigned to the assignee of the instant invention.

As further shown in FIG. 1, the upper rack 15 of the dishwashing apparatus 10 is supported within the washing chamber 12 by means of a horizontally elongated track 19 generally S-shaped in cross section and located at each side wall 20 of the washing chamber 12 between each side portion of the upper rack 15 and each side wall 20. Each track 19 includes upper outwardly facing and lower inwardly facing guideways 21 and 22 for receiving side wall mounted rollers (not shown) and rack mounted rollers 23, respectively. The rollers 23 each engage with and are movable in the track guideways 21 and 22 to allow the upper rack 15 to be moved in and out of the washing chamber 12 for loading or unloading dishes.

The upper dishwasher rack 15 as shown in FIG. 1 is designed to substantially occupy the side-to-side width and front-to-rear depth of the upper portion of the washing chamber 12. The dishwasher rack 15 is constructed from a plurality of generally horizontally disposed longitudinal and lateral wire members 24 and 25 arranged or arrayed in a criss-cross fashion to form a lattice-work rack bottom. The ends and sides of the dishwasher rack 15 are formed by wire members 26 and 29 which are generally vertically disposed extensions of the horizontally disposed longitudinal and lateral wire members 24 and 25 of the lattice-work rack bottom. As further shown in FIG. 1, a pair of horizontally disposed wire members 30 extend around the upper periphery of the rack 15 and cooperate with the vertically disposed wire members 26 and 29 to define the outer boundaries of the dishwasher rack 15.

Figure 2:
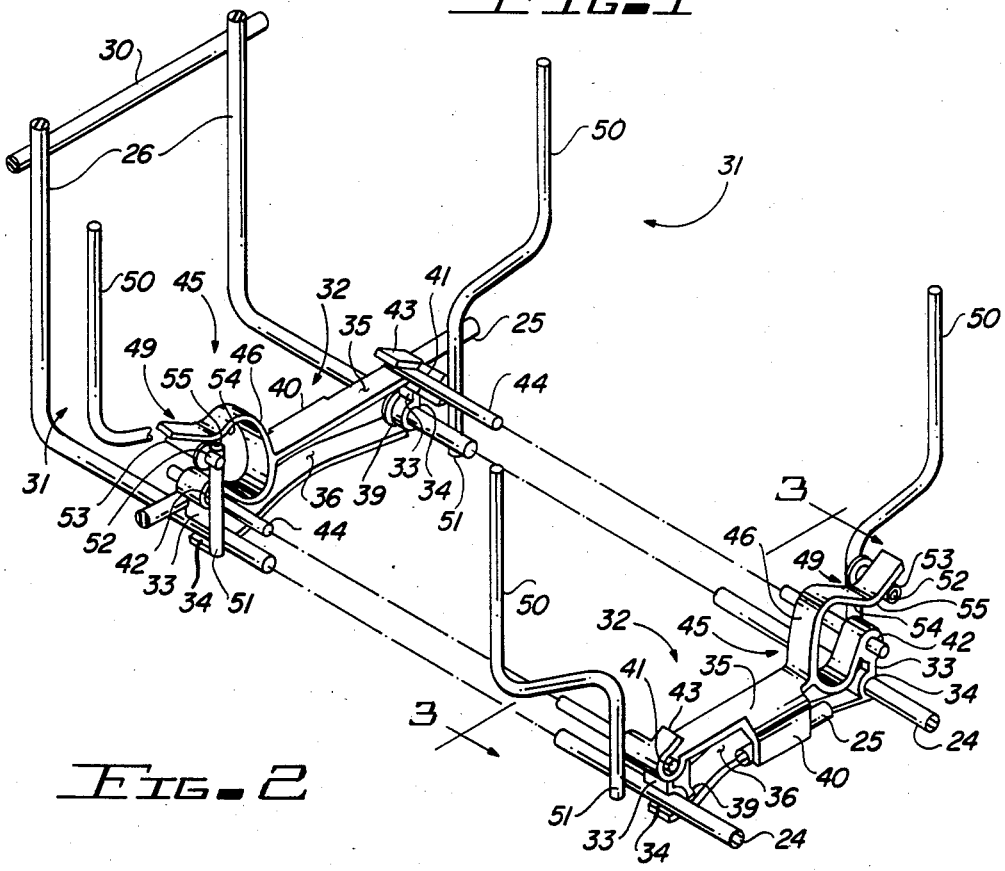
FIG. 2 is an isometric view of the center rear portion of the upper dishwasher rack indicated generally by lines 2—2 of FIG. 1 and showing a pair of the pivoted dividers.
Figure 3:
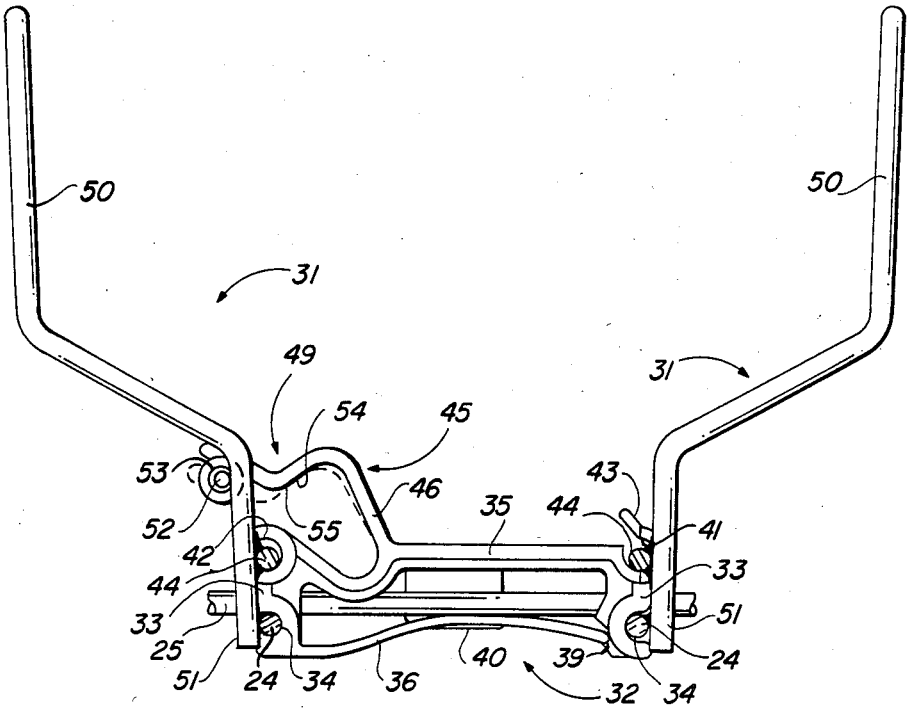
FIG. 3 is an enlarged fragmentary view of a portion of the dishwasher rack of FIG. 1 showing a pair of the pivoted rack dividers in the upright posture and taken generally along lines 3—3 of FIG. 2.
Figure 4:
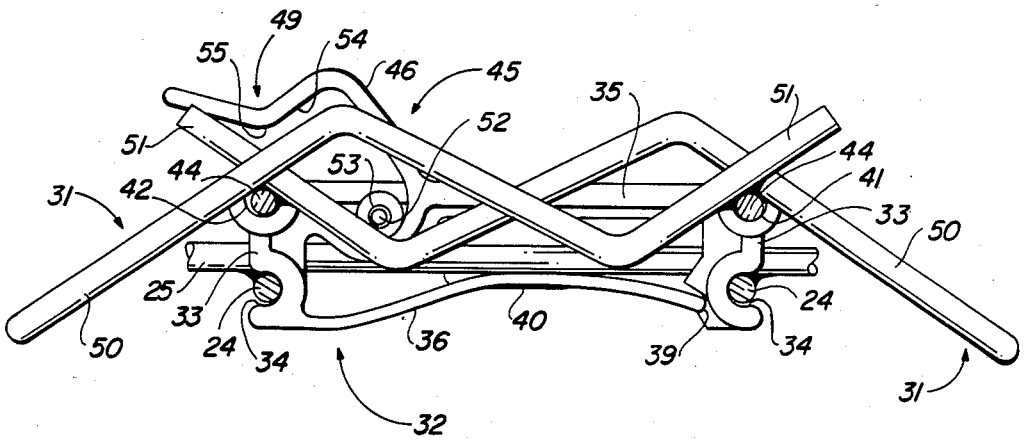
FIG. 4 is a view similar to FIG. 3 showing the pivoted rack dividers of FIG. 3 in the folded posture.

Referring now to FIGS. 2–4, there is shown a unique arrangement of pivoted divider means or pivoted rack dividers 31 which are manually positionable between an upright posture as shown in FIGS. 2 and 3 and a folded posture as shown in FIG. 4. FIGS. 2–4 depict a pair of pivotable rack dividers 31 arranged from front to back in the rear portion of the upper dishwasher rack 15 of FIG. 1. These rack dividers 31 could also be arranged in a side-to-side fashion and could be located in the front of the upper dishwasher rack 15, in the bottom dishwasher rack (not shown) or wherever it might be desirable for providing increased flexibility in loading of various dishes and utensils.

As best shown in FIGS. 2–4, pivot support members 32 are molded from a suitable thermoplastic material and are attached between adjacent longitudinal wires 24 of the dishwasher rack 15. The pivot support members 32 each have a pair of depending legs 33 with opposite facing notches or grooves 34 for engagement with the adjacent longitudinal wires 24 of the dishwasher rack 15 as best shown in FIGS. 3 and 4. The pivot support members 32 also include a body portion 35 extending transversely between and interconnecting the pair of depending legs 33.

As further shown in FIGS. 2–4, a lock bar or arm 36 is arranged in cantilevered fashion from one of the depending legs 33. When the pivot support member 32 has been positioned between the adjacent longitudinal wires 24, the lock bar 36 is upwardly deformed and snapped into a detent 39 in the other depending leg 33 to effectively bias the depending legs 33 sideways against the adjacent longitudinal wires 24 for locking the pivot support member 32 thereto.

Extending outwardly and downwardly from the top of the body portion 35 of the pivot support member 32 is a locating tab 40 which engages with one of the lateral wires 25 of the dishwasher rack 15 for retaining the pivot support member 32 parallel to and in close proximity to that lateral wire 25.

Each pivot support member 32 further includes a pair of pivot apertures 41 and 42 as best illustrated in FIGS. 3 and 4. The pivot aperture 41 is slotted and includes a molded tab 43 useful for spreading open the slot of the pivot aperture 41 to accept the axle portion 44 of a rack divider 31. Juxtaposed to the unslotted pivot aperture 42 is a generally arcuately shaped cantilevered spring arm 45. The spring arm 45 is attached to the body portion 35 of the pivot support member 32 and defines a generally C-shaped biasing member 46. The free end of the C-shaped biasing member 46 includes a substantially V-shaped cam lobe 49 spaced above the unslotted pivot aperture 42.

As further shown in FIGS. 1 and 2, a pair of pivot support members 32 are mounted between adjacent longitudinal wires 24 and are spaced an appropriate distance apart. The pair of pivot support members 32 are rotated 180° from each other so that, as shown in FIG. 2, the slotted pivot aperture 41 in one pivot support member 32 will be opposite and generally aligned with the unslotted pivot aperture 42 in the other pivot support member 32. This arrangement will place the C-shaped biasing member 46 of the pivot support members 32 in diagonally opposed corners of an imaginary rectangle constructed around the perimeter of the pair of pivot support members 32.

Pivoted divider means or pivoted rack dividers 31 are provided for assembly between the generally axially aligned slotted and unslotted pivot apertures 41 and 42 of the pivot support members 32. As illustrated in FIGS. 2 and 3, each pivoted rack divider 31 is an assembly which includes an axle portion 44 to which a plurality of spacer pins 50 have been attached. The spacer pins 50 are arranged along the axle 44 of the pivoted rack divider 31 so that the spacer pins 50 of an opposed pair of pivoted rack dividers 31 are offset from one another by a minimum of one diameter to eliminate interference when in the folded posture of FIG. 4.

As best shown in FIGS. 2 and 3, at least one of the spacer pins 50 includes a portion 51 which extends below the axle portion 44 and engages with a longitudinal wire 24 to limit pivotal movement of the pivoted rack divider 31 in the upright direction. The pivoted rack dividers 31 are of a standard length and the spacer pins 50 are arranged so that a single standard configuration could be used throughout the dishwasher rack 15. As further illustrated in FIG. 3, the spacer pins 50 in this embodiment are formed so that they extend outwardly as well as vertically. This is representative of a particular embodiment and a plurality of other variations are possible for achieving different side-to-side spacings.

The pivoted rack dividers 31 are assembled between a slotted and an unslotted pivot aperture 41 and 42 of the pivot support members 32 by first inserting one end of the axle portion 44 into the unslotted aperture 42 and then spreading the tab 43 and inserting the other end of the axle portion 44 into the slotted aperture 41. As best shown in FIGS. 2–4, the spacer pin 50 adjacent the unslotted pivot aperture 42 includes a follower arm 52 extending into the interior of the C-shaped biasing member 46 at generally a right angle to the spacer pin 50. The follower arm 52 is enclosed by a cylindrical thermoplastic sleeve 53 for reducing frictional abrasion as the follower arm 52 contacts the V-shaped cam lobe 49.

FIGS. 1–3 show the pivoted rack dividers 31 in the upright or raised posture while FIG. 4 shows the pivoted rack dividers 31 in the folded or lowered posture. The pivoted rack dividers 31 may be manually positioned in either the folded or raised posture on an individual basis or in groups by grasping a spacer pin 50 associated with the rack divider 31 to be moved and pivoting the axle portion 44 about the substantially horizontal axis of the pivot apertures 41 and 42. Counterclockwise rotation of the left-hand pivoted rack divider 31, as viewed in FIGS. 3 and 4, will move the left-hand pivoted rack divider 31 from the folded posture of FIG. 4 to the upright posture of FIG. 3. This counterclockwise rotation of the left-hand pivoted rack divider 31 will effect arcuate movement of the follower arm 52 within the interior of the C-shaped biasing member 46 of the rear support member so that the follower arm and sleeve 52 and 53 will contact the inside edge 54 of the V-shaped cam lobe 49. Continued rotation of the pivoted rack divider 31 will effect upward deformation or flexing of the C-shaped biasing member 46 from the dashed line undeformed posture of FIG. 3 until the spring force of the C-shaped biasing member 46 is overcome and the follower arm 52 has moved past the center 55 of the V-shaped cam lobe 49. Counterclockwise rotation will continue since the biasing effect of the flexed C-shaped biasing member 46 will tend to move the pivoted rack divider 31 into the upright posture of FIG. 3 with the downwardly extending portion 51 of the spacer pin 50 contacting a longitudinal wire 24.

Rotation of the same pivoted rack divider 31 in the clockwise direction will move the pivoted rack divider 31 from the upright posture of FIG. 3 to the folded posture of FIG. 4. Initial pivotal movement of the pivoted rack divider 31 must overcome the downward biasing force of the deformed C-shaped biasing member 46. Once the follower arm 52 has been moved clockwise past the center 55 of the V-shaped cam lobe 49, the natural downward movement of the C-shaped biasing member 46 returning to its normal undeformed posture will force the pivoted rack divider 31 to pivot toward the folded posture of FIG. 4. It can thus be seen that the biasing force of the C-shaped biasing member 46 and the V-shaped cam lobe 49 associated therewith control the upright or folded location of the pivoted rack divider 31 dependent upon which side of the center 55 of the V-shaped cam lobe 49 the follower arm 52 is on.

Figure 5:
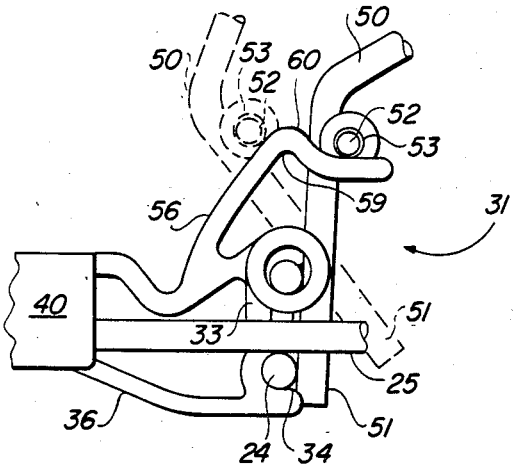
FIG. 5 is a fragmentary section view showing an alternate support member construction.

Turning now to FIG. 5, there is shown an alternate embodiment of the cantilevered spring arm identified by the numeral 56. In this alternate embodiment, V-shaped cam lobe 59 is inverted and the follower arm and sleeve 52 and 53 are mounted so that the follower arm 52 will depress the spring arm 56. Once the follower arm 52 has been pivoted past the center or high point 60 of the inverted V of the cam lobe 59, the spring arm 56 will bias the pivoted rack divider 31 toward either the upright or the folded posture.

Figure 6:
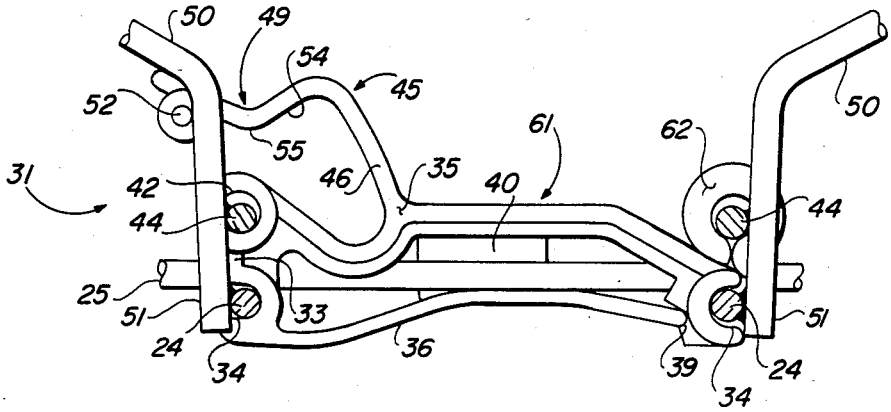
FIG. 6 is a fragmentary section view similar to FIG. 3 showing modified mounting arrangement.

FIG. 6 depicts a variation of the pivot support member generally identified by the numeral 61. In this variation the slotted pivot member of the preferred embodiment is removed from the support member 61 and a pivot loop 62 is formed in the appropriate location on the lateral wire member 25. To assemble the pivoted rack divider 31 between the pivot aperture 42 and the pivot loop 62, one end of the axle portion 44 of the pivoted rack divider 31 would be assembled to the pivot support member 61 and the other end would be inserted into the pivot loop 62 prior to securing the pivot support member 61 to the longitudinal rack wires 24. To eliminate this relatively minor assembly difference, the pivot aperture 42 in the pivot support member 62 could be slotted to allow the assembly procedure similar to the preferred embodiment.

Figure 7:
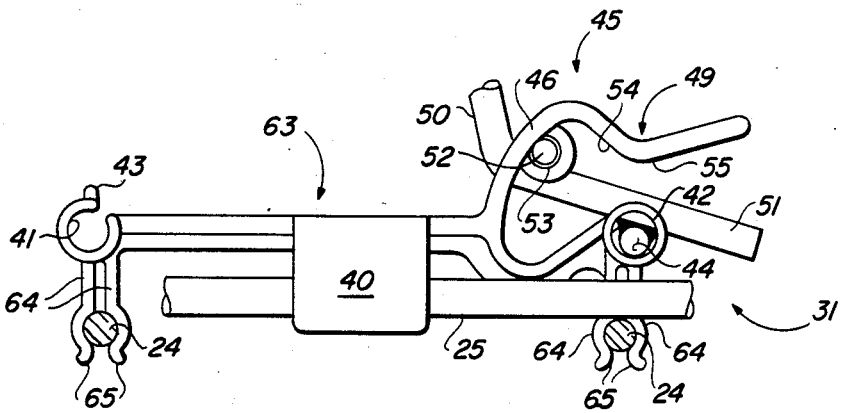
FIG. 7 shows an alternate method of securing a support member to the rack wires.

In FIG. 7 there is shown an alternate method of attaching the pivot support member identified by the numeral 63 to the adjacent longitudinal wires 24. In this embodiment each end of the pivot support member 63 includes a pair of downwardly extending spaced-apart finger-like members 64 having outwardly flared ends 65. Each pair of finger-like members 64 is designed to deflect sideways as the pivot support member 63 is assembled to a pair of longitudinal wires 24 allowing the finger-like members 64 to surround the wires 24 and secure the pivot support member 63 thereto.

There has thus been shown a dishwasher rack with pivoted dividers which are manually positionable between folded and unfolded postures. The pivot support members are effectively locked in place between adjacent rack wires and the pivoted rack dividers mounted between the pivot support members are usable on an individual basis or as a group to provide supports for a variety of "standard" or "non-standard" dish and utensil loads. The C-shaped biasing member of a pivot support member exerts biasing pressure on a follower arm associated with the pivoted rack divider for effectively controlling the posture of the pivoted rack divider.

In the drawings and specification there is set forth a preferred embodiment of the invention and although specific terms are employed these are used in a generic and descriptive sense only and not for purposes of limitation. Changes in the form and the proportion of parts as well as the substitution of equivalents are contemplated as circumstances may suggest or render expedient without departing from the spirit or scope of the invention as defined in the following claims.

We claim:

1. A dishwasher rack assembly having a pivoted divider member, comprising: means defining a basic rack having a bottom wall including a plurality of spaced-apart longitudinal and lateral wire members; pivoted divider means having a selectable upright position and comprising a plurality of generally upstanding wire elements connected to at least one generally horizontal wire element; and at least one unitary support member for pivotally supporting one end portion of said pivoted divider means on said bottom wall for movement between said upright position and a folded-down position, said support member including a body portion and integral attaching means engageable with wire members of said dishwasher rack for attaching said support member to said bottom wall, means integral with said body portion defining at least one pivot aperture for receiving said end portion of said pivoted divider means, means for receiving and pivotally supporting the other end portion of said pivoted divider means, and combination camming and resilient biasing means integral with said body portion and engageable with a portion of said pivoted divider means for biased movement thereof from an intermediate position toward one of said upright and folded-down positions.

2. A dishwasher rack assembly having a pivoted divider member as defined in claim 1 wherein said attaching means includes a pair of mounting legs engageable with a pair of adjacent wire members.

3. A dishwasher rack assembly having a pivoted divider member as defined in claim 2 wherein said pair of mounting legs of said support member include oppositely facing grooves for engaging with said adjacent wire members.

4. A dishwasher rack assembly having a pivoted divider member as defined in claim 1 wherein said pivot aperture of said support member is substantially axially aligned with a second pivot aperture spaced from said support member and formed as part of said dishwasher rack assembly for receiving an end portion of said pivoted divider means.

5. A dishwasher rack assembly having a pivoted divider member, comprising: means defining a dishwasher rack having substantially upstanding front, rear and side walls and a generally horizontally disposed bottom wall formed from a plurality of spaced-apart longitudinal and lateral wire members; a pair of support members secured to an adjacent pair of said longitudinal or lateral wire members in a spaced-apart arrangement, each of said support members including a pivot aperture substantially axially aligned with the pivot aperture in the other support member; pivoted divider means selectively movable between a folded and an upright position and including axle means pivotally supported between said axially aligned pivot apertures, said pivoted divider means further including a plurality of pins spaced along and generally perpendicular to said axle means; follower means associated with said pivoted divider means and in spaced juxtaposition to one of said pivot apertures; and combination camming and biasing means associated with at least one of said support members, said camming means located in the path of said follower means for contact therewith as said pivoted divider means is manually pivoted between one of said folded or upright positions, said biasing means deformable responsive to the position of said follower means for urging said pivoted divider means toward one of said folded and upright positions.

6. A dishwasher rack assembly having a pivoted divider member as defined in claim 5 wherein said combination camming and biasing means includes a substantially inverted V-shaped cam lobe, said biasing means of said combination being deformed as said follower means contacts the highest point of said cam lobe to urge said pivoted divider means toward one of said positions.

7. A dishwasher rack assembly having a pivoted divider member as defined in claim 5 wherein said combination camming and biasing means is generally C-shaped and includes a substantially V-shaped cam lobe formed in the top portion of the C-shape, the top portion of said C-shape being deformed as said follower means contacts the lowest point of said cam lobe to urge said pivoted divider means toward one of said positions.

8. A dishwasher rack assembly having a pivoted divider member as defined in claim 5 wherein said support members are secured to an adjacent pair of said longitudinal wire members and each includes a tab engagable with a lateral wire member for longitudinally positioning said support members within said dishwasher rack assembly.

9. A dishwasher rack assembly having a pivoted divider member as defined in claim 5 wherein said pair of support members are identical and are secured to said wire members rotated 180° from each other, said support members cooperatively providing two pair of axially aligned pivot apertures for receiving a pair of said pivoted divider means between said pair of support members.

10. A dishwasher rack assembly having a pivoted divider member, comprising: means defining a dishwasher rack having substantially upstanding front, rear and side walls and a generally horizontally disposed bottom wall formed from a plurality of spaced-apart longitudinal and lateral wire members; first and second spaced-apart support members each including a pair of depending legs with oppositely facing grooves for engaging with an adjacent pair of said longitudinal wire members to attach said support members thereto, said first and second support members being substantially identical but reversed with respect to each other when attached to said longitudinal wire members and each further including a pair of pivot apertures generally axially aligned between said first and second support members; a pair of pivoted dividers selectively movable between folded and upright positions, each pivoted divider including axle means pivotally supported in a pair of said axially aligned pivot apertures between said first and second support members, each pivoted divider further including a plurality of pins spaced along and generally perpendicular to said axle means for defining dish supports when said pivoted dividers are in said upright position; follower means associated with each pivoted divider; and a combination camming and biasing member associated with each of said first and second support members, said combination camming and biasing member including cam means in cooperable alignment with said follower means, said pivoted dividers being pivotally operable for effecting movement of said follower means into contact with said cam means to deform said camming and biasing member for urging said pivoted dividers toward one of said folded or upright positions.

11. The dishwasher rack assembly having a pivoted divider member as defined in claim 10 wherein said support members each include a tab engageable with a lateral wire member for longitudinally positioning said support members within said dishwasher rack assembly.

12. The dishwasher rack assembly having a pivoted divider member as defined in claim 10 wherein said support members each include a cantilevered arm associated with one of said depending legs and engageable with a detent in the other of said depending legs for biasing said depending legs into locking engagement with said adjacent pair of longitudinal wire members.

13. A dishwasher rack assembly having a pivoted divider member, comprising: means defining a basic rack having a bottom wall including a plurality of spaced-apart longitudinal and lateral wire members; pivoted divider means having a selectable upright position and comprising a plurality of generally upstanding wire elements connected to at least one generally horizontal wire element; and at least one unitary support member for pivotally supporting said pivoted divider means on said bottom wall for movement between said upright position and a folded-down position, said support member including a body portion and attaching means having a pair of mounting legs including oppositely facing grooves for engaging with adjacent wire members of said dishwasher rack for attaching said support member to said bottom wall, one of said mounting legs including a deformable locking member and the other mounting leg including a detent cooperable with said locking member for locking said support member to said adjacent wire members, at least one pivot aperture associated with said body portion for receiving an end portion of said pivoted divider means, and combination camming and biasing means integral with said body portion and engageable with a portion of said pivoted divider means for biasing thereof toward one of said upright and folded-down positions.

14. A dishwasher rack assembly having a pivoted divider member, comprising: means defining a basic rack having a bottom wall including a plurality of spaced-apart longitudinal and lateral wire members; pivoted divider means having a selectable upright position and comprising a plurality of generally upstanding wire elements connected to at least one generally horizontal wire element; and at least one unitary support member for pivotally supporting said pivoted divider means on said bottom wall for movement between said upright position and a folded-down position, said support member including a body portion and attaching means engageable with a pair of adjacent longitudinal wire members of said dishwasher rack for attaching said support member to said bottom wall, said support member further including a tab engageable with a lateral wire member of said bottom wall for longitudinally positioning said support member within said dishwasher rack assembly, at least one pivot aperture associated with said body portion for receiving an end portion of said pivoted divider means, and combination camming and biasing means integral with said body portion and engageable with a portion of said pivoted divider means for biasing thereof toward one of said upright and folded-down positions.

15. A dishwasher rack assembly having a pivoted divider member, comprising: means defining a basic rack having a bottom wall including a plurality of spaced-apart longitudinal and lateral wire members; pivoted divider means having a selectable upright position and comprising a plurality of generally upstanding wire elements connected to at least one generally horizontal wire element; and a pair of spaced-apart support members rotated 180° from one another and each support member including a pair of pivot apertures generally axially aligned with the pair of pivot apertures in the other support member for pivotally supporting a pair of said pivoted divider means on said bottom wall for movement between said upright position and a folded-down position, said support members each including a body portion and attaching means engageable with wire members of said dishwasher rack for attaching said support members to said bottom wall, and combination camming and biasing means integral with each of said body portions and engageable with a portion of one of said pivoted divider means for biasing thereof toward one of said upright and folded-down positions.

* * * * *